US009066543B2

(12) United States Patent
Cameron

(10) Patent No.: US 9,066,543 B2
(45) Date of Patent: Jun. 30, 2015

(54) CONTAINER DEVICE AND APPARATUS

(71) Applicant: The Safe Cig, LLC, Los Angeles, CA (US)

(72) Inventor: John Cameron, Los Angeles, CA (US)

(73) Assignee: The Safe Cig, LLC, Los Angeles, CA (US)

( * ) Notice: Subject to any disclaimer, the term of this patent is extended or adjusted under 35 U.S.C. 154(b) by 0 days.

(21) Appl. No.: 13/956,336

(22) Filed: Jul. 31, 2013

(65) Prior Publication Data

US 2014/0097103 A1 Apr. 10, 2014

Related U.S. Application Data

(60) Provisional application No. 61/677,812, filed on Jul. 31, 2012.

(51) Int. Cl.
*A24F 47/00* (2006.01)
*A24F 15/18* (2006.01)

(52) U.S. Cl.
CPC ..... *A24F 47/008* (2013.01); *A24F 15/18* (2013.01)

(58) Field of Classification Search
CPC ..... A24F 15/00; A24F 15/08; A24F 15/12; A24F 15/14; A24F 15/16; A24F 15/18; A24F 15/02; A24F 7/004; A24F 7/008; B65D 85/10; B65D 85/1009; B65D 85/1036; B65D 85/1045; B65D 85/1081; B65D 85/109; B65D 85/12
USPC ..... 131/231, 238, 240.1, 242, 250; 206/38, 206/236, 242, 246, 249–251, 256, 264–268, 206/271, 273, 276; 229/120.04, 120.06, 229/120.08, 120.38, 160.1
See application file for complete search history.

(56) References Cited

U.S. PATENT DOCUMENTS

| | | | | | |
|---|---|---|---|---|---|
| 1,158,826 | A | * | 11/1915 | Mendelson | 206/256 |
| 1,610,647 | A | * | 12/1926 | Anderson | 206/90 |
| 2,958,417 | A | * | 11/1960 | Adams | 206/246 |
| 3,090,482 | A | * | 5/1963 | Sandacz | 206/246 |
| 3,861,523 | A | * | 1/1975 | Fountain et al. | 206/236 |
| 4,789,059 | A | * | 12/1988 | Kim | 206/246 |
| 5,074,412 | A | * | 12/1991 | White | 206/256 |
| 5,467,872 | A | * | 11/1995 | Minarelli et al. | 206/256 |
| 5,558,216 | A | * | 9/1996 | Focke et al. | 206/256 |

(Continued)

FOREIGN PATENT DOCUMENTS

CN 201290340 Y * 8/2009

*Primary Examiner* — Bryon Gehman
*Assistant Examiner* — Brijesh V. Patel
(74) *Attorney, Agent, or Firm* — Marc S. Kaufman; Reed Smith LLP

(57) ABSTRACT

An apparatus including a box having a plurality of compartments, a first cover movable to open a first compartment adapted to hold one or more fluid vaporization related products, and a second cover movable to open a second compartment adapted to hold an electronic charging device. The movement of the second cover can be restricted by one or more objects inserted through a partition between the first and the second compartments, such as an electronic cigarette battery and/or an electronic cigarette. A hinge can be adapted to move the covers between a first position in which a compartment is closed and a second position in which the compartment is open, the covers can be detached to open a compartment and reattached to close the compartment, and the cover can be a first portion of one or more exterior faces of the box and can slide to open the compartment.

15 Claims, 7 Drawing Sheets

(56) References Cited

U.S. PATENT DOCUMENTS

| | | | | |
|---|---|---|---|---|
| 5,899,326 | A * | 5/1999 | Benhamou et al. | 206/246 |
| 6,644,470 | B1 * | 11/2003 | Grayson | 206/92 |
| 2002/0020640 | A1 * | 2/2002 | Garcia | 206/246 |
| 2003/0063523 | A1 * | 4/2003 | Mulaw | 368/10 |
| 2004/0216753 | A1 * | 11/2004 | Fox | 131/242 |
| 2005/0236282 | A1 * | 10/2005 | Huska | 206/246 |
| 2010/0313899 | A1 * | 12/2010 | Wu | 131/238 |
| 2012/0227753 | A1 * | 9/2012 | Newton | 131/347 |

* cited by examiner

CONTAINER DEVICE AND APPARATUS

RELATED APPLICATION DATA

This application claims priority to U.S. Provisional Application No. 61/677,812, filed Jul. 31, 2012, the disclosure of which is hereby incorporated by reference in its entirety.

BACKGROUND

An electronic cigarette, or e-cigarette, is a device that simulates the act of tobacco smoking by producing an inhaled vapor which can bear the appearance, flavor, and feel of inhaled tobacco smoke. Compared to tobacco smoking, e-cigarettes provide an ostensibly safer "smoking" experience by reducing the combustion process that occurs when tobacco is burned, resulting in fewer toxins and carcinogens. This is accomplished through the use of heat to vaporize a liquid solution into an inhalable mist.

Many e-cigarettes include a fluid cartridge and a battery component. However, compared to the ease of carrying around a pack of cigarettes, storage of multiple fluid cartridges and batteries can be troublesome for users. Therefore, improvements in storage technology are needed.

BRIEF SUMMARY

An apparatus is disclosed, including a box having a plurality of compartments, a first cover movable to open a first compartment adapted to hold one or more fluid vaporization related products, and a second cover movable to open a second compartment adapted to hold an electronic charging device.

The movement of the second cover can be restricted by one or more objects inserted through a partition between the first and the second compartments, such as an electronic cigarette battery and/or an electronic cigarette.

A variety of opening mechanisms can be used to move the first cover. A hinge can be adapted to move the first cover between a first position in which the first compartment is closed and a second position in which the first compartment is open, the first cover can be detached to open the first compartment and reattached to close the first compartment, and the first cover can be a first portion of one or more exterior faces of the box and can slide relative to a second portion of the one more exterior faces of the box to open the first compartment. The first compartment can also be a drawer having at least a portion of the first cover as an external face.

A hinge can also be adapted to move the second cover between a first position in which the second compartment is closed and a second position in which the second compartment is open. The hinge can couple the second cover to an obstruction member extending into the second compartment, such that the second cover and the obstruction member rotate in unison about the hinge. The movement of the second cover can then be restricted by an object inserted through a partition between the first and the second compartments which presses against or otherwise prevents movement of the obstruction member.

The second compartment can be a drawer having at least a portion of the second cover as an external face. The second cover can be detached to open the second compartment and reattached to close the second compartment. The second cover can be a first portion of one or more exterior faces of the box and can slide relative to a second portion of the one more exterior faces of the box to open the second compartment.

The one or more fluid vaporization related products can include an electronic cigarette cartridge and/or an electronic cigarette battery. The electronic charging device can be a USB device and can be adapted to charge an electronic cigarette battery.

DETAILED DESCRIPTION

While devices and apparatuses are described herein by way of examples and embodiments, those skilled in the art recognize that such devices and apparatuses are not limited to the embodiments or drawings described. It should be understood that the drawings and description are not intended to be limited to the particular form disclosed. Rather, the intention is to cover all modifications, equivalents and alternatives falling within the spirit and scope of the appended claims. Any headings used herein are for organizational purposes only and are not meant to limit the scope of the description or the claims. As used herein, the word "may" is used in a permissive sense (i.e., meaning having the potential to) rather than the mandatory sense (i.e., meaning must). Similarly, the words "include," "including," and "includes" mean including, but not limited to.

The disclosed device and apparatus provides a carrying container for users to carry items, such as fluid vaporization related products and related electronic devices. However, the embodiment disclosed is not limited to carrying or storing fluid vaporization related products and can be used as a container for many different types of items. For example, the compartments in the container can hold any product, such as cigarettes, shortened cigarettes, snack foods, candy, liquids, or any other item capable of fitting in the compartments. Various aspects of the disclosed embodiment are described in greater detail below with reference to the drawings.

Container Shape

Figure 1A:
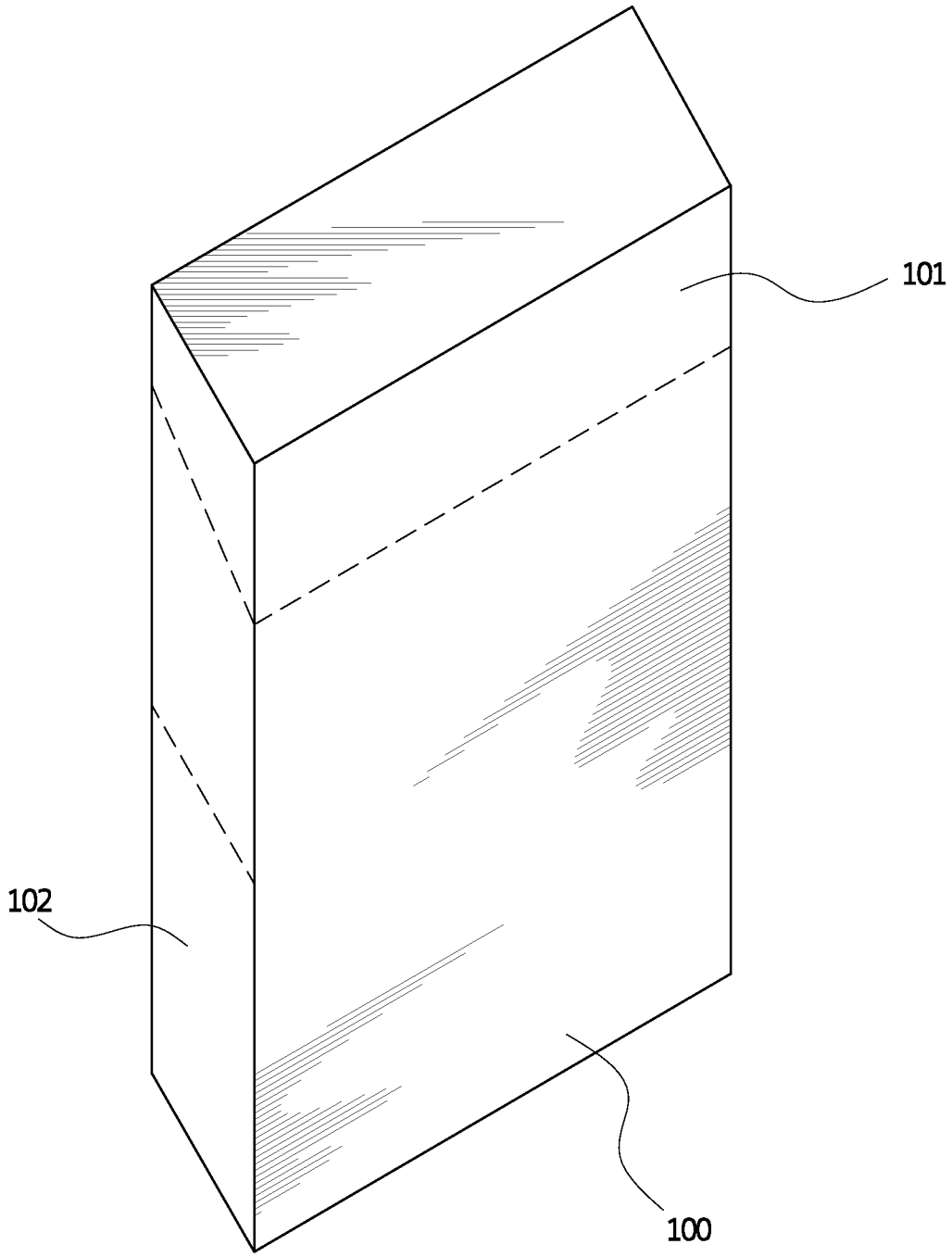
FIG. 1A shows an external view of an exemplary container apparatus in a rectangular cuboid shape with two compartments in the closed position according to the disclosed embodiment.

FIG. 1A illustrates an apparatus with two compartments in the closed position. Box 100 is shown as being a rectangular cuboid shaped figure with six faces, but can be any suitable shape and can have any number of faces. Furthermore, the opposite faces do not necessarily have to be flat parallel planes, but can lie on intersecting planes or be curved faces. For example, the box may be cubic, octagonal, or spherical. The box may be a cylindrical tube, or a pyramid, or any other geometrical shape in accordance with the disclosed embodiment. Additionally, the faces do not have to meet at right angles as they do in a rectangular cuboid, and the shape may be a parallelepiped constructed with faces that meet at acute and obtuse angles.

Container Construction Materials

The box 100 and its components can be constructed out of any suitable material or combination of suitable materials, such as paper, cardboard, plastics, rubbers, metals, glass, foam, or any other material that can be fashioned into a box or container. Different components can be used for different parts of the box. For example, the box can be made of cardboard, with hinges made of plastic, or made out of plastic with covers made out of paper. Many different variations are possible.

Covers and Possible Cover Locations

Numeral 101 references a first cover which is formed as part of the box 100, but can be a separate component that is attached to the box. First cover 101 conceals a first compartment within the box which can be used for storing fluid vaporization products. First cover 101 is shown as including multiple faces of the box but may be designed differently. For example, first cover 101 can be any one of the faces of the box, part of one of the faces, or only include part of the top face of the box. First cover 101 can be oriented to run along the longitudinal axis rather a transverse axis. If the box 100 is cylindrical, then the first cover 101 can also be cylindrical, with circular bottom edge. First cover 101 does not necessarily have to touch any edges and may be entirely contained within one face of the box.

Second cover 102 conceals a second compartment within the box 100, and can also be placed on a different section of the box 100 or have different dimensions. For example, second cover 102 can be placed on the front face of the box rather than a side face, second cover 102 can include multiple faces or edges of the box, second cover 102 can be tetrahedron shaped and have a corner as its apex. Second cover 102 can be placed opposite first cover 101 so that it includes the bottom face of the box 100. Second cover 102 can be entirely contained in one face of the box 100, for example, if first cover 101 is entirely contained in the top face and second cover 102 is entirely contained in one of the side faces. Second cover 102 does not necessarily have to touch any edges and may be entirely contained within one face of the box. There are many possible arrangements for each of the two covers.

Compartment Locations and Quantity

Additionally, the box 100 is not necessarily limited to two compartments or two covers. For example, the box can have one compartment that is accessible through both covers in different areas, the box can have three covers and one compartment, or three covers and two compartments, such as an upper compartment accessible through one cover and a lower compartment accessible through the two remaining covers. The box can have three separate compartments and three separate covers, such as one cover on the top face to access a first compartment, a cover on the left face to access a second compartment, and a cover on the right face to access a third compartment.

Figure 1B:
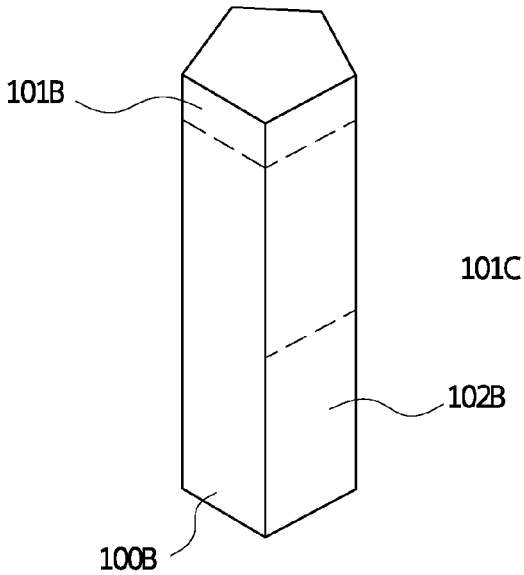
FIG. 1B shows an external view of an exemplary container apparatus in a pentagonal shape with two compartments in the closed position according to the disclosed embodiment.
Figure 1C:
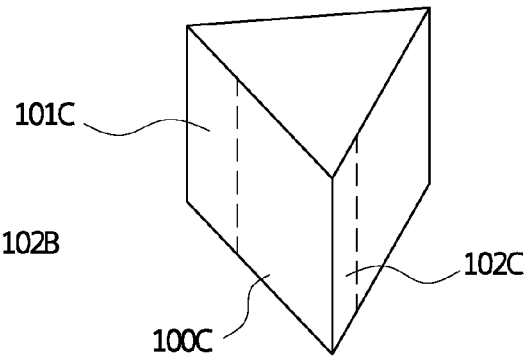
FIG. 1C shows an external view of an exemplary container apparatus in a triangular shape with two compartments in the closed position according to the disclosed embodiment.
Figure 1D:
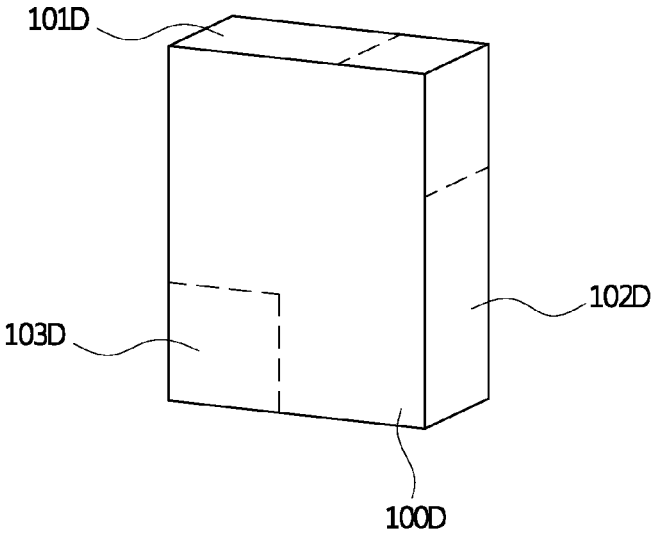
FIG. 1D shows an external view of an exemplary container apparatus in a rectangular cuboid shape with three compartments in the closed position according to the disclosed embodiment.

FIG. 1B illustrates a version of the apparatus having a pentagonal shape 100B, a first cover 101B, and a second cover 102B. FIG. 1C illustrates a version of the apparatus having a triangular shape 100C, a first cover 101C, and a second cover 102C. FIG. 1D illustrates a version of the apparatus having a rectangular cuboid shape 100D, a first cover 101D, a second cover 102D, and a third cover 103D.

Compartment Access and Cover Attachment Mechanisms

Figure 2:
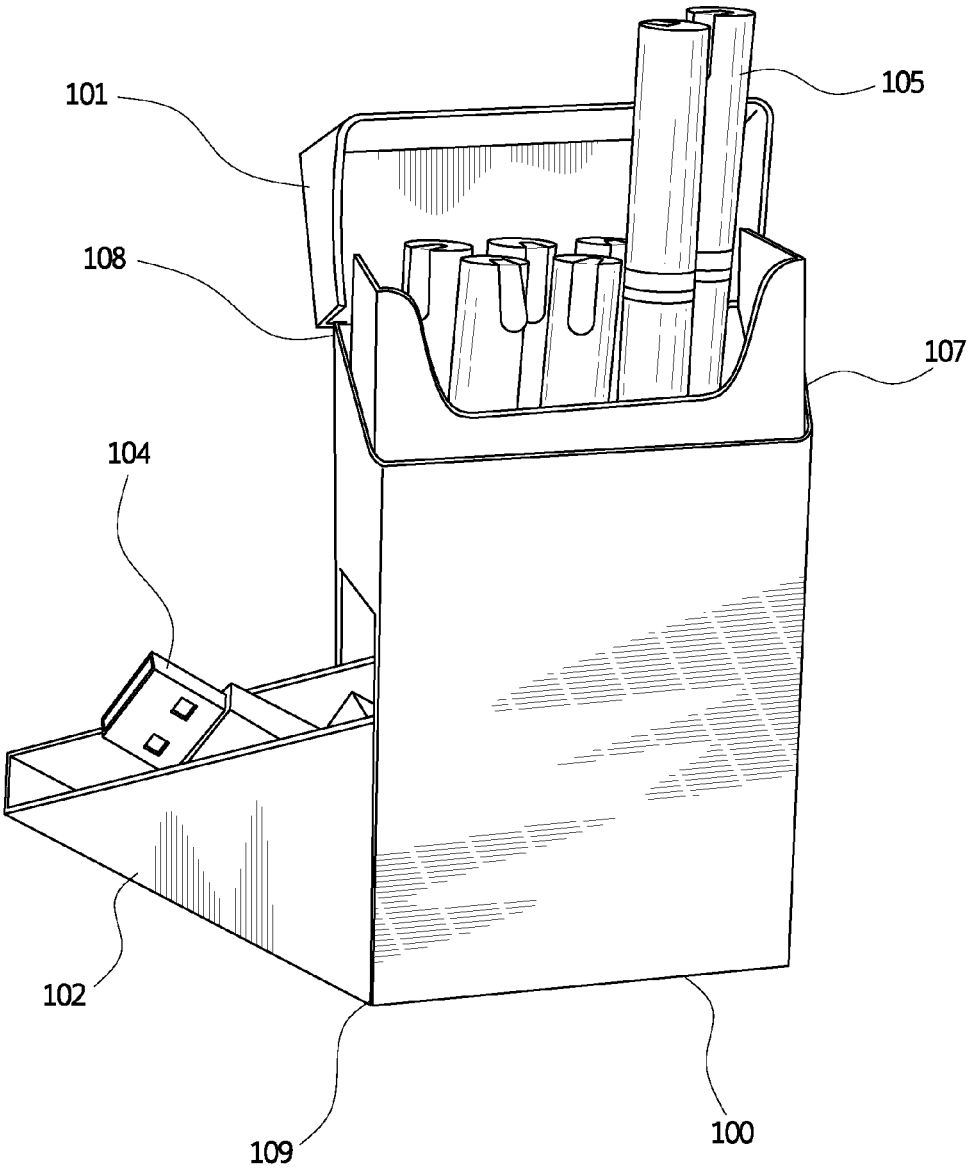
FIG. 2 shows an external view of an exemplary container apparatus with two compartments in the open position according to the disclosed embodiment.

FIG. 2 shows the box 100 of FIG. 1A with both covers open. First cover 101 is shown as being rotationally coupled to the box 100 at first hinge 108 but other arrangements are possible. For example, the hinge can lie on the left face of box 100 rather than along the back face. The hinge can also be on an edge between faces. Similarly, second cover 102 is shown as being rotationally coupled to the box 100 at second hinge 109, but the hinge can run along the back left edge, left face, or front left edge rather than the bottom left edge. The hinge may be built into the construction of the box such that it is formed by a bending of the material that makes up the box. Hinge may also be an insert such as a wire or other material that allows the cover to rotate. The hinge may be constructed from a material that is different than the material which is used for the rest of the box. Many variations of hinges and hinge locations are possible and this disclosure is not intended to limit the embodiment to the variations disclosed herein. The cover can have a lip, handle or nub which allows a user to grip and move the cover more easily.

The covers can also be designed without hinges. For example, the covers can be detachable and re-attachable so that a user may remove them to access a compartment and reattach them to close the compartment. The covers can be disposable, in which case the user can remove them permanently. The covers can also be configured as sliding doors that cover a first portion of one or more faces of the box and can be slid under or over a second portion of the one or more faces. For example, first cover 101 can be implemented as a strip of material running along the top of the box in the shape of an upside-down U. To open the first compartment in that scenario, the user would slide the cover over or under an adjacent portion of the top of the box.

Figure 3:
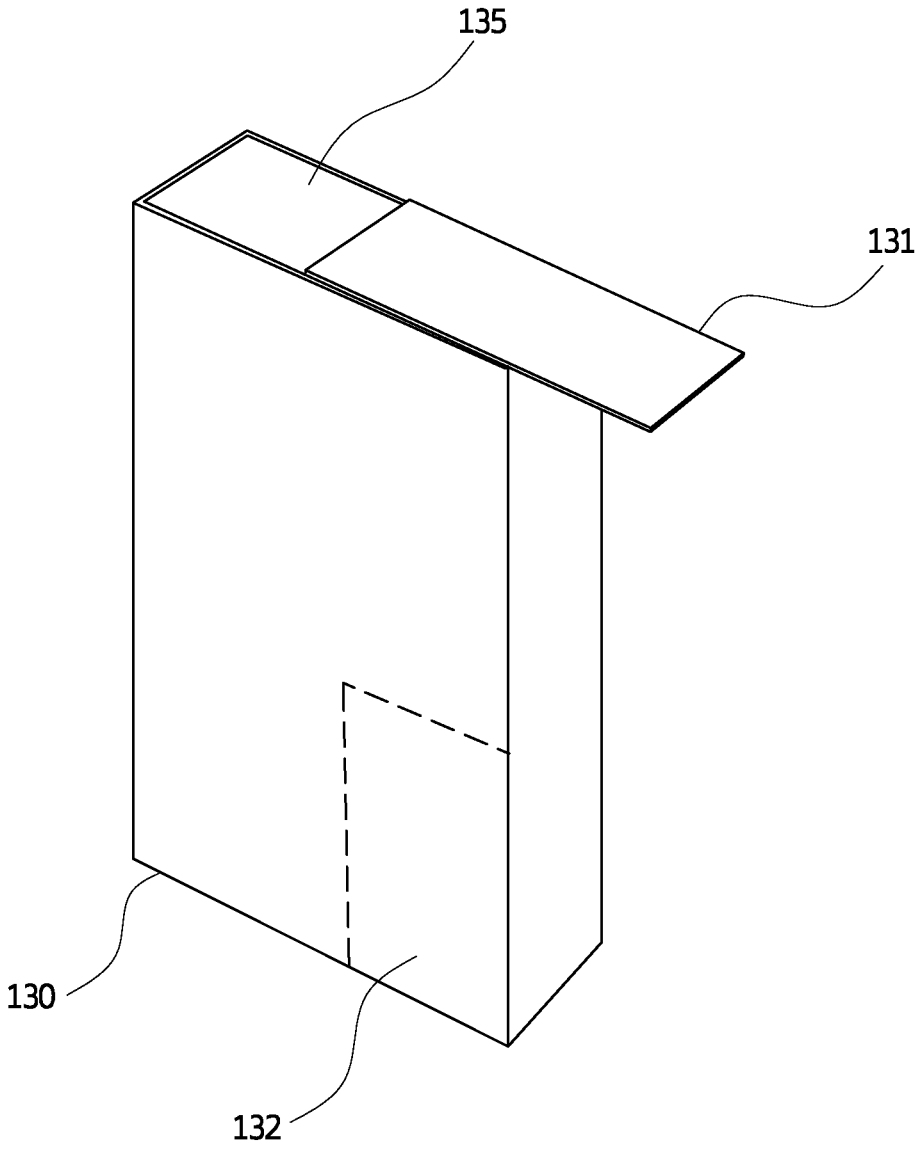
FIG. 3 shows an external view of an exemplary container apparatus with one compartment having a sliding cover in the open position and another cover in the closed position.

Additionally, the cover can slide outwards rather than over a portion of the box. FIG. 3 illustrates an example of this. The box 130 in FIG. 3 includes a first cover 131 and a second cover 132. First cover 131 is shown in the open position, sliding outwards to reveal compartment 135 underneath.

The compartments can be designed as drawers having the covers as one or more external faces. To open the compartment, a user can pull the cover outwards to pull out the drawer. To facilitate this, the cover can have a handle, nub, or other gripping mechanism attached to the external surface that allows a user to manipulate it.

The cover may have a biasing member, such as a spring or rubber band, attached to it so that it automatically returns to a closed position. Alternatively, the cover may be biased to the open position and may be held in place with a latch on the side of the box or inside the compartment to keep it in the closed position. For example, second cover 102 can be configured so that the user can apply pressure to push it inwards and unlock a latch, at which point the cover would extend outwards.

Compartment Contents and Partitions Between Compartments

Compartment one is shown containing fluid vaporization related products 105. The fluid vaporization products can be electronic cigarettes or electronic cigars, batteries for electronic vaporization devices, fluid cartridges for electronic devices, or any other suitable products. The products 105 can be secured in a partition between the first and second compartments. For example a partition that has grooves for electronic cigarette cartridges can be used to hold any number of cartridges. Additionally, the partition may have one or more openings through which longer or larger objects can be inserted. For example, an electronic cigarette or a battery for an electronic cigarette can be inserted through the opening of the partition and extend into a second compartment. As described in greater detail below, a product inserted from the first compartment into the second compartment can act as a locking mechanism of sorts, preventing the second cover from moving and the second compartment from opening. For example, if the second compartment is a drawer and the user inserts an electronic cigarette into the first compartment, through the partition, and into the second compartment so that it pins one wall of the drawer against the inside of the box, thereby retaining the second compartment in the closed position such that the user will not be able to pull the second cover to pull out the drawer.

Of course, the products can be stored and secured within the first compartment in any manner, and do not necessarily have to be inserted into a partition. For example, a collar 107 is shown in FIG. 2 and can be used to hold the products in place. The collar can be designed so that it is tall enough to keep products in the compartment, but not so tall that the cover cannot be closed. The collar can also be omitted. The compartment may contain pockets for holding items, either built in to the compartment or in the form of an insert. The partition or insert or other compartment component used to hold the products in place may be designed to have a low profile relative to the product so that the products can be easily gripped by a user. Additionally, the first compartment can run from the top to the bottom of the box along one side, in which case the partition would not be underneath the products.

The partition may be designed with openings wide enough to allow a particular object to pass when force is applied, but narrow enough to hold the object in place in the absence of force. The partition can also be constructed out of any suitable material, for example, foam, rubber, plastic or paper.

Electronic Devices and Charger Arrangements

Compartment two is shown containing a USB charger 104 secured in the compartment. Of course, any type of electronic charger can be inserted into the compartment, such as a wall outlet charger, solar charger, or a charger utilizing a different protocol than USB. The charger can also be wired so that it is connected to an electronic cigarette or cigarette battery in a different compartment for easier charging. For example, the user can open compartment two and plug the charger into a power source without having to manually attach the electronic cigarette battery to the charger. In this scenario, one of the openings in the partition can be configured as a charge port adapted to receive a battery and charge it when the charger is plugged in. The USB charger can be adapted to fit a variety of devices. For example, the USB charger can be used to charge a cell phone or an mp3 player. As shown in the figure, the charger can jut out of the basket for easy extraction by the user. The charger can be in a pocket which can be attached to the compartment or built into the design of the compartment or basket to hold the charger in place. The pocket can be constructed from foam or some other similar material to securely hold the charger. Additionally, the items stored inside the second compartment do not necessarily have to be pulled out of a basket when the second cover is opened. For example, the second cover can function as a door, or as a removable cover that allows users to reach inside the second compartment to retrieve the items stored inside.

Compartment two does not have to contain a charger or an electronic device, and can contain any item. It can contain some item which complements the products in other compartments. For example, compartment one can contain bread sticks and compartment two can contain a cheese dip for the bread sticks. Compartment one can contain chicken nuggets and compartment two can contain barbeque sauce. Many variations are possible.

Compartment Shape, Locking Mechanisms, Overextension Guard, and Ejection Mechanism In FIG. 2, compartment two is shaped as a triangular basket that has one edge of second cover 102 as one its vertices, the face of second cover 102 as one of its external faces, second hinge 109 at another one of its vertices, and the last vertex concealed within the box. In this example, when a user inserts an object into the first compartment, through the partition, and into the second compartment, it can contact an internal face of the triangular basket and prevent the second cover 102 from opening. This locking mechanism can prevent the contents of the second compartment, such as the USB charger, from unintentionally falling out of the compartment.

The hinge used to rotate the basket may be formed by coupling the basket to a segment of material which is coupled to the bottom face or bottom inner face of the box. The segment of material may also be inserted between layers that form the bottom side of the box.

Although not visible in the figure, the internal face of the triangle and the partition also prevent the basket from overextending outwards from the inside of the box. As the user rotates the cover, the internal edge of the basket contacts a bottom face of the partition and causes the basket and cover to stop moving, preventing the basket from jutting too far out of the opening.

Additionally, the internal face of the basket may act as an ejection mechanism for an object in compartment one which is inserted through the partition and is in contact with the internal face. For example, if a user has an electronic cigarette inserted through the partition and touching the internal face, then by pulling cover two open, the internal face can contact the bottom of the electronic cigarette and push it up.

Many other variations of a compartment are contemplated. The compartment can be an open cavity rather than a basket holding items. The basket can be shaped differently, such as a basket having two semicircles for walls. In the case of a drawer compartment, the shape of the basket can be rectangular.

The second compartment can be constructed without a basket shape and still include a locking mechanism. The hinge can couple the second cover to an obstruction member that extends into the second compartment, such that the second cover and the obstruction member rotate in unison about the hinge. For example, an L shaped member having the second cover as one of its segments, the hinge as a vertex, and the obstruction member as the other segment. Of course, the obstruction member does not have to have a planar or linear shape. It can be a rod, a curved segment, or any other extension that goes into the second compartment. In this example, when a user inserts an object through the first compartment and the partition into the second compartment, it can press against the obstruction member which is coupled to the second cover, preventing the second cover from rotating about the hinge and opening the second compartment. Obstruction member can also serve to perform the overextension guard and ejection mechanisms discussed with regard to the internal face.

Figure 4:
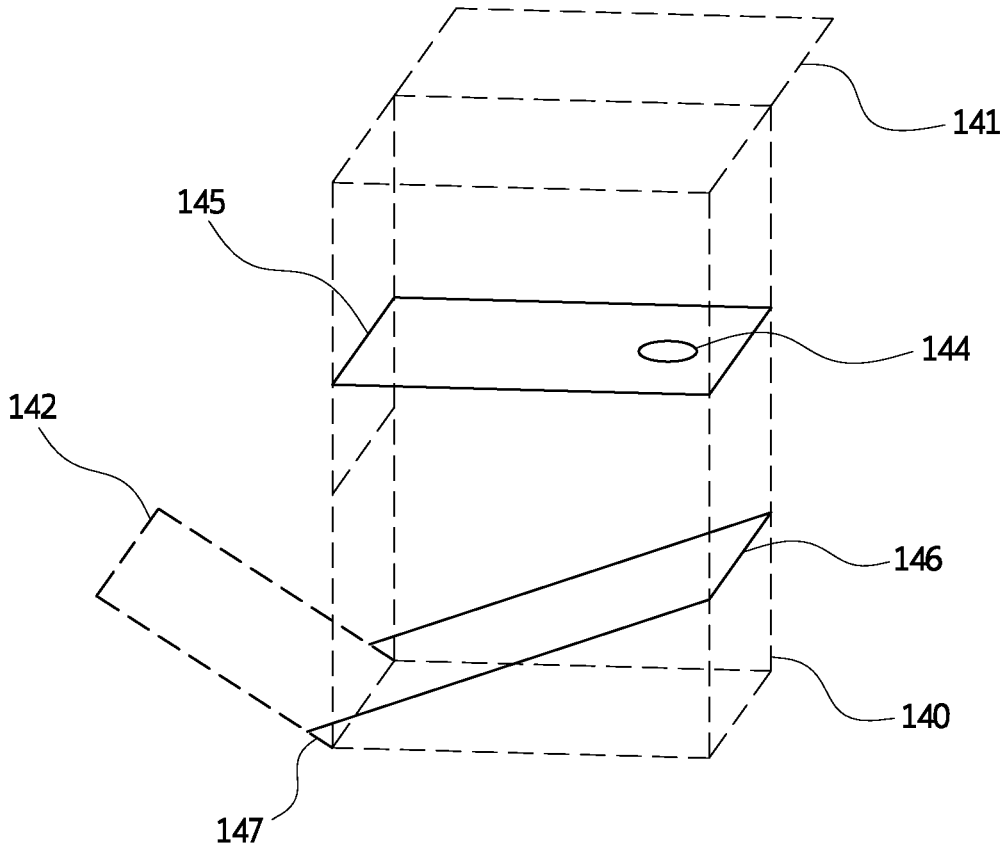
FIG. 4 illustrates the internal structure of the partition and the obstruction member in an exemplary container apparatus.

FIG. 4 illustrates an internal view of a box 140 with a first cover 141 and a second cover 142, in the open position. Second cover 142 is attached to an obstruction member 146 such that they rotate in unison about hinge 147. If a user inserts an object, such as an electronic cigarette battery, through opening 144 in partition 145, it will contact obstruction member 146, pushing it downwards, and can hold the second cover 142 in the closed position. From this position, the user can pull the second cover 142 outwards to eject the electronic cigarette battery through the opening 144. Additionally, even in the absence of the electronic cigarette battery inserted through the opening 144, the second cover is prevented from overextending outwards by the obstruction member 146, which will contact the partition 145 when rotated past a certain point.

Visible Features of the Box

Figure 5:
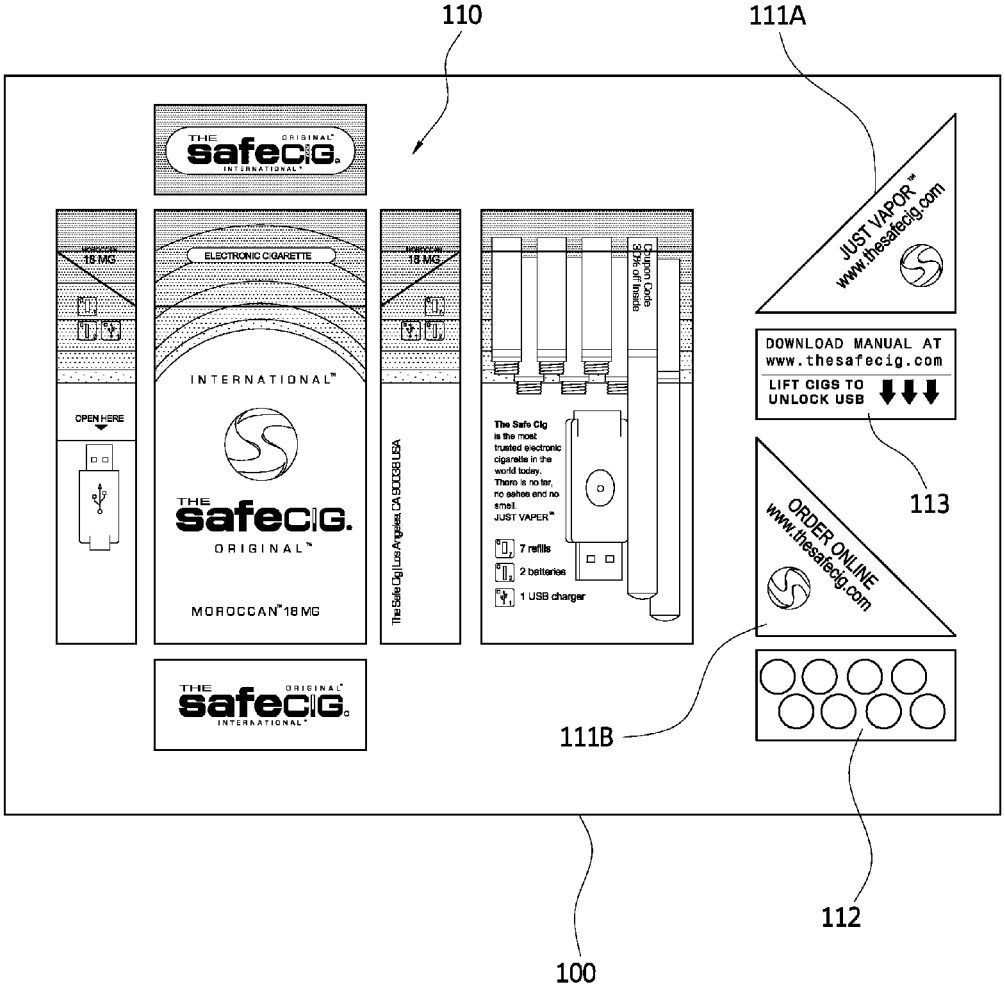
FIG. 5 shows the different possible features that can make up the container apparatus according to the disclosed embodiment.

FIG. 5 illustrates an exploded view showing different features of the box 100. Numeral 110 denotes the different faces of the box 100 shown in the earlier figures. As discussed earlier, boxes with varying numbers of faces or shapes are also envisioned. Partition 112 is one possible partition that can be place between compartments. Although partition 112 is shown as having multiple openings, it is not limited to such a design. For example, the partition can have no openings, or can have one or more openings and one or more pockets or cradles for holding fluid vaporization related products within the first compartment. The openings do not have to be circular, and can be any shape or dimension, such as a rectangle or triangle. 111A and 111B show the two sides of the triangular basket partially shown in FIG. 2. As discussed earlier, one or both of these basket side faces can be removed from the apparatus, or can be replaced with side faces having a different shape or configuration.

Information Displayed on Box Features

Numeral 113 shows an insert that can be placed under the first cover that is visible when the compartment is open. The insert 113 and the other components of the box 100, such as the faces 110 are shown displaying information related to SafeCig products. For example, the insert explains how users can download the manual related to the product. However, any type of information or image can be depicted on the components of the box, 100. The information displayed on the insert 113, the faces 110, or the side walls of the basket 111A-111B, can be advertisements, dosage information, ingredients, health information, website addresses, images, or any other information. The information can be printed on to the box 100 components, or can be printed on to a sticker or other paper and attached to the box.

Box Construction and Components

Figure 6:
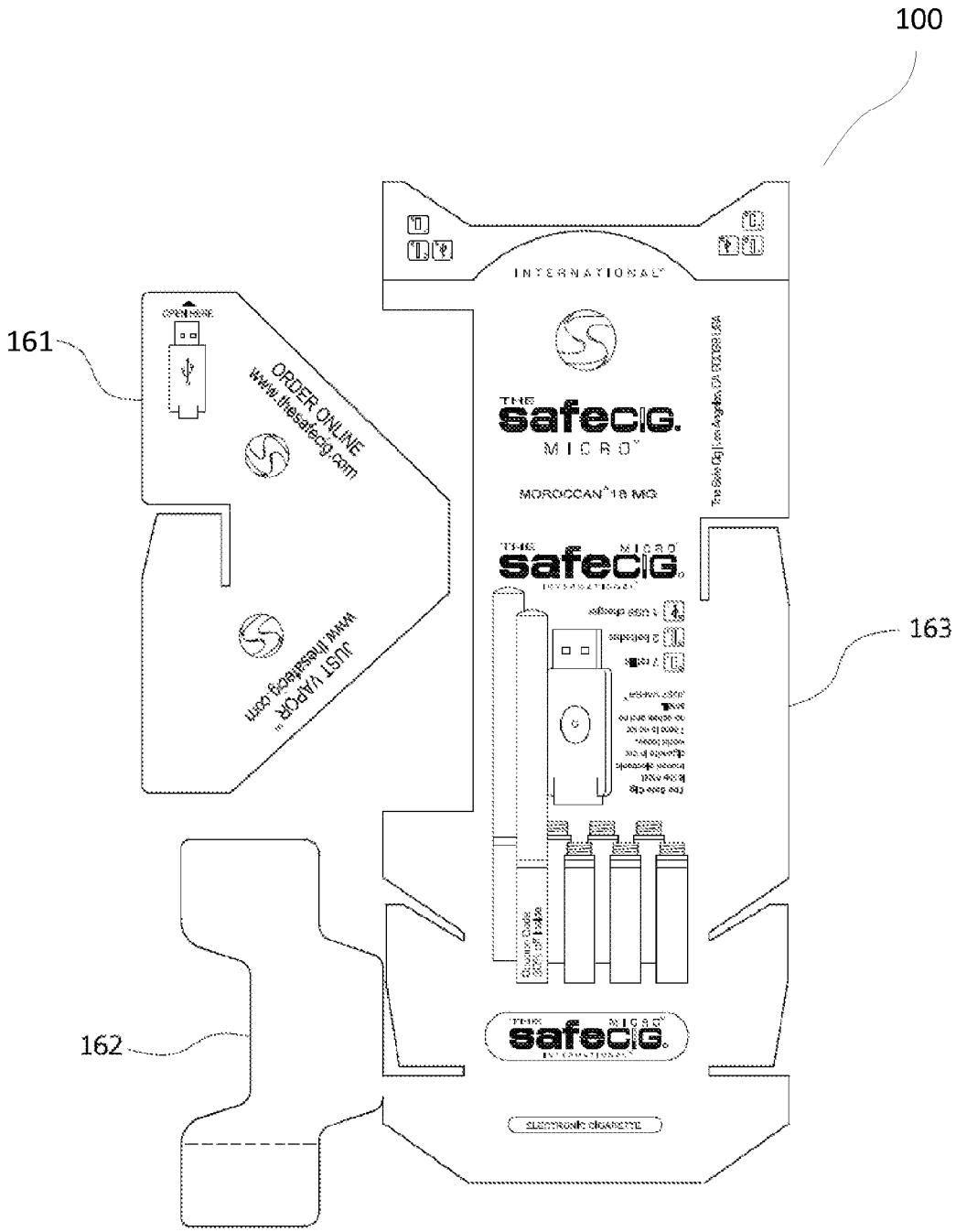
FIG. 6 shows the components that can be used to construct the container apparatus according to the disclosed embodiment.

FIG. 6 shows an exploded view of one possible construction of the components that can be used to make up the box. Three components are shown which can be configured into the shape of the box shown in FIGS. 1A and 2. As shown in the figure, almost the entire box 100 is constructed from a single piece of material 163. The only portion of the box which is not accounted for by the single piece 163 is the second cover which is constructed as part of the second piece of material 161 which forms the basket. Of course, the number of components can be greater or fewer depending on the material used and method of construction. The box can be constructed from a single piece of material. For example, by replacing the basket used for the second cover with a cover that is a flap constructed as part of the box and which moves on a hinge which is integral to the box, the box and covers of the apparatus can be produced from a single piece of material.

The collar 162 is also shown in FIG. 6 but is not a required part of the box, may be replaced with other similar components which serve the same function of keeping products in the compartment, or can be removed from the apparatus completely.

In FIG. 6 each of the components is made from a paper or similar material, but if the box is constructed from a plastic or some other material, the box can be a single component that is injection molded. The components shown are for illustration only and are not meant to limit the variety of possible arrangements of different components that can be used for the box.

Many variations of an apparatus for carrying items are disclosed herein. However, various modifications can be made without departing from the scope of the disclosed embodiment as defined by the appended claims and legal equivalents.

What is claimed is:

1. An apparatus comprising:

a box having a plurality of compartments;

a first cover movable to open a first compartment, the first compartment being configured to hold one or more fluid vaporization related products; and a second cover movable to open a second compartment, the second compartment being configured to hold an electronic charging device, the second compartment being further configured such that movement of the second cover is restricted when one or more objects are inserted through a partition between the first and the second compartments.

2. The apparatus of claim 1, wherein the one or more objects comprise at least one of an electronic cigarette battery and an electronic cigarette.

3. The apparatus of claim 1, further comprising a hinge configured to move the first cover between a first position in which the first compartment is closed and a second position in which the first compartment is open.

4. The apparatus of claim 1, wherein the first compartment further comprises a drawer having at least a portion of the first cover as an external face.

5. The apparatus of claim 1, wherein the first cover is configured to be detached to open the first compartment and reattached to close the first compartment.

6. The apparatus of claim 1, wherein the first cover includes a first portion of one or more exterior faces of the box and is configured to slide relative to a second portion of the one more exterior faces of the box to thereby open the first compartment.

7. The apparatus of claim 1, further comprising a hinge configured to move the second cover between a first position in which the second compartment is closed and a second position in which the second compartment is open.

8. The apparatus of claim 7, wherein the hinge couples the second cover to an obstruction member extending into the second compartment, such that the second cover and the obstruction member rotate in unison about the hinge.

9. The apparatus of claim 8, wherein the movement of the second cover is configured to be restricted by an object inserted through the partition between the first and the second compartments which presses against the obstruction member.

10. The apparatus of claim 1, wherein the second compartment further comprises a drawer having at least a portion of the second cover as an external face.

11. The apparatus of claim 1, wherein the second cover is configured to be detached to open the second compartment and reattached to close the second compartment.

12. The apparatus of claim 1, wherein the second cover includes a first portion of one or more exterior faces of the box and is configured to slide relative to a second portion of the one more exterior faces of the box to open the second compartment.

13. The apparatus of claim 1, wherein the one or more fluid vaporization related products comprise at least one of an electronic cigarette cartridge and an electronic cigarette battery.

14. The apparatus of claim 1, wherein the electronic charging device comprises a USB device.

15. The apparatus of claim 1, wherein the electronic charging device is configured to charge an electronic cigarette battery.

* * * * *